US008181777B2

(12) United States Patent
Suchan et al.

(10) Patent No.: US 8,181,777 B2
(45) Date of Patent: May 22, 2012

(54) TEARABLE APPLICATOR PACKAGING

(75) Inventors: Matthias Suchan, Hachenburg (DE); Alexander Bublewitz, Herborn (DE)

(73) Assignee: Kettenbach GmbH & Co. KG, Eschenburg (DE)

( * ) Notice: Subject to any disclaimer, the term of this patent is extended or adjusted under 35 U.S.C. 154(b) by 0 days.

(21) Appl. No.: 12/490,127

(22) Filed: Jun. 23, 2009

(65) Prior Publication Data

US 2010/0018881 A1 Jan. 28, 2010

(30) Foreign Application Priority Data

Jun. 25, 2008 (DE) ..... 10 2008 029 762

(51) Int. Cl.

| | |
|---|---|
| ***B65D 83/10*** | (2006.01) |
| ***B65D 81/24*** | (2006.01) |
| ***B65D 71/00*** | (2006.01) |
| ***B65D 65/26*** | (2006.01) |
| ***A45D 40/24*** | (2006.01) |

(52) U.S. Cl. ..... 206/361; 132/317; 206/209; 206/210; 206/229; 229/87.05; 401/132

(58) Field of Classification Search ..... 206/209, 206/209.1, 210, 229, 469, 349, 361, 363; 132/317, 318, 320; 229/87.05; 383/209; 401/118, 122–125, 129, 132

See application file for complete search history.

(56) References Cited

U.S. PATENT DOCUMENTS

| | | | | |
|---|---|---|---|---|
| 2,864,118 | A * | 12/1958 | Adams et al. | 206/229 |
| 3,086,647 | A * | 4/1963 | Krezanoski | 206/363 |
| 3,185,291 | A * | 5/1965 | Lerner | 206/209 |
| 3,186,628 | A * | 6/1965 | Rohde | 383/209 |
| 3,369,267 | A * | 2/1968 | Friedland et al. | 401/132 |
| 3,498,448 | A * | 3/1970 | Kuster | 206/469 |
| 3,685,645 | A * | 8/1972 | Kawaguchi | 206/210 |
| 3,759,375 | A * | 9/1973 | Nappi | 206/361 |
| 3,835,834 | A * | 9/1974 | Brown et al. | 206/229 |
| 4,220,244 | A * | 9/1980 | Elmore | 206/210 |
| 4,889,228 | A | 12/1989 | Gueret | |
| 4,982,838 | A * | 1/1991 | Fitjer | 206/209 |
| 5,112,152 | A * | 5/1992 | McBride | 401/132 |
| 5,244,089 | A * | 9/1993 | Yang et al. | 206/469 |
| 5,320,217 | A * | 6/1994 | Lenarz | 206/209 |
| 5,660,273 | A * | 8/1997 | Discko, Jr. | 206/229 |
| 6,105,761 | A | 8/2000 | Peuker et al. | |
| 6,516,947 | B1 * | 2/2003 | Van Dyke et al. | 206/361 |
| 6,685,013 | B2 * | 2/2004 | Discko, Jr. | 206/229 |
| 2002/0185401 | A1 * | 12/2002 | Duquet et al. | 206/461 |
| 2005/0150904 | A1 | 7/2005 | Suchan et al. | |

(Continued)

FOREIGN PATENT DOCUMENTS

| | | |
|---|---|---|
| DE | 3874714 T2 | 4/1993 |

(Continued)

*Primary Examiner* — Bryon Gehman

(74) *Attorney, Agent, or Firm* — McDonnell Boehnen Hulbert & Berghoff LLP

(57) ABSTRACT

The invention relates to a tearable packaging (1) for receiving at least one substance (6) and an applicator (7, 11), comprising a, for example, film-like carrier (2) in which at least one depression (4*a*, 4*b*) open on one side is formed which can be sealed towards the outside with a cover film (3) to form at least one chamber and comprising a channel (5*a*, 5*b*) formed between the carrier (2) and the cover film (3) in which the applicator (7, 11) is accommodated at least in sections in such a manner that the applicator (7, 11) is completely enclosed by the carrier (2) and the cover film (3).

26 Claims, 4 Drawing Sheets

U.S. PATENT DOCUMENTS

| | | | |
|---|---|---|---|
| 2008/0230408 | A1 | 9/2008 | Sogaro |

FOREIGN PATENT DOCUMENTS

| | | | |
|---|---|---|---|
| DE | 29814215 | U1 | 10/1998 |
| DE | 19962436 | A1 | 7/2001 |
| DE | 202004007693 | U1 | 7/2004 |
| EP | 0895943 | A2 | 2/1999 |
| EP | 1021356 | B1 | 7/2000 |
| EP | 1972358 | A1 | 9/2008 |
| WO | 2004/041107 | A2 | 5/2004 |

* cited by examiner

TEARABLE APPLICATOR PACKAGING

CROSS-REFERENCE TO RELATED APPLICATIONS

This application claims priority under 35 U.S.C. §119(a)-(d) to German patent application no. 10 2008 029 762.3, filed Jun. 25, 2008, which is hereby incorporated by reference in its entirety.

BACKGROUND OF THE INVENTION

1. Field of the Invention

The invention relates generally to packaging. The invention relates more particularly to tearable packaging, for example for use in packaging applicators and substances useful in dentistry.

2. Technical Background

One type of tearable packaging is known from WO 2004/041107 A2 (EP 1 555 952). To open this known packaging, one end of the packaging must be torn off or cut off, wherein both the carrier and also the cover film must be cut through. In this way, the end of the applicator facing away from the chambers becomes accessible. The provision of a notch or the like to facilitate the tearing off of one end of the packaging is only appropriate if no applicator or the like is located in the end to be torn off. Otherwise the applicator would block the progress of the tear and therefore make opening difficult.

There remains a need in the art for packaging which is particularly suitable for an applicator having an elongate handle and allows particularly simple and rapid opening of the packaging.

SUMMARY OF THE INVENTION

One aspect of the invention is a tearable packaging for receiving at least one substance and an applicator, comprising, for example, a film-like carrier in which at least one depression open on one side is formed which can be sealed towards the outside with a cover film to form at least one chamber and comprising a channel formed between the carrier and the cover film in which the applicator is accommodated at least in sections in such a manner that the applicator is completely enclosed by the carrier and the cover film.

In certain embodiments, a tear-off aid for defined opening of the packaging is provided in an area of the channel in the carrier and/or in the cover film facing the at least one chamber, which tear-off aid has two weakened regions located one behind the other in the longitudinal direction of the channel. It is therefore possible to grasp the packaging between the two weakened regions and tear it in a defined manner so that the entire section of the packaging located between the two weakened regions can be torn off. This section of packaging between the two weakened regions thus acts as a tear-off strip whereby the packaging is divided into two parts after removal of this tear-off strip. The part enclosing the elongate handle of the applicator can thereby easily be removed so that the applicator is accessible and the at least one substance can be removed from the packaging by means of the applicator.

The channel between the carrier and the cover film can in this case be configured as a recessed depression in the carrier and/or the cover film or it can be formed by placing these one upon the other and welding or sealing these to one another, for example.

According to a preferred embodiment of the invention, the weakened regions are formed by incisions, perforations, notch points, tapered material sections or the like. In this case, the two weakened regions need not have the same weakening, for example, an incision in each case. Rather, it is sufficient if each of the weakened regions is configured in such a manner that it allows a defined initiation of tearing for tearing off the section of the packaging located between the two weakened regions. It has proved to be particularly advantageous if the weakenings in the carrier or the cover film are more strongly defined than in the respectively other element. Thus, an initiation of tearing is only facilitated, for example, in the cover film so that the cover film can be detached more effectively from the carrier. Thus, for example, an incision in the cover film can be made deeper than an incision in the carrier to facilitate the initial tearing.

In certain embodiments of the invention, a tear-off aid having at least one tear-off tab is integrally formed with the carrier or the cover film wherein the joining between the carrier and the cover film is weaker in the region of the tear-off tab compared with the region located opposite the tear-off tab. Preferably, the joining between the carrier and the cover film, which may be a sealing, a bonding, a welding or the like, is weaker in the region of the tear-off tab compared with the further region of the packaging and the joining between the carrier and the cover film is equal to or stronger in the region located opposite the tear-off tab compared with the further region of the packaging. Thus, in certain embodiments the joining in the region located opposite the tear-off tab shall not be sheared-off or separated in another way manually, at least with forces resulting from the usual opening of such a packaging.

According to a preferred embodiment, a weakening, like a cut, in the region of the tear-off tab is provided only in the material which is integrally formed with the tear-off tab, i.e. in the carrier or the cover film, whereas a weakening, like a recess, in the region located opposite the tear-off tab is provided in the carrier and the cover film. Said weakenings may be located opposite each other, i.e. they can be arranged abutting the tear-off tab on the side facing to the depression seen in the longitudinal direction of the channel.

Further, it is preferred if the joining between the carrier and the cover film does not range to the outer edge (border) of the packaging in the region of the tear-off tab. In other words, in the region of the tear-off tab a gap may be provided between the carrier and the cover film.

Advantageously, a weakening, like a cut, is provided on each side of the tear-off tab in the longitudinal direction of the channel only in the material which is integrally formed with the tear-off tab, i.e. in the carrier or the cover film, such that two weakened regions located one behind the other in the longitudinal direction of the channel are formed.

The opening of the packaging by tearing off the section of the packaging located between the two weakened regions can be further facilitated by providing respectively two weakened regions located one behind the other in the longitudinal direction of the channel on both sides of the channel. However, these additional weakened regions can also be dispensed with, for example, if the width of the packaging is very small and/or the material of the carrier and/or the cover film can be cut through particularly easily.

In order to tightly close off at least one substance and the applicator during transport and storage, e.g., to prevent the escape of the substance as well as the penetration of bacteria or contaminants, the carrier and the cover film are preferably sealed to one another. A sealing is understood in this case as any suitable connection of the carrier to the cover film, for example, an adhesive bonding or welding.

The opening of this packaging is further facilitated by configuring the sealing to be weaker in the area of the tear-off aid on one side of the channel than on the opposite side of the channel. It is thereby made possible that on the side on which initiation of the tearing takes place, the carrier and the cover film are easily detached from one another but on the opposite side the carrier and the cover film are firmly bonded to one another in order that the entire section of the packaging located between the two weakened regions can be completely separated, i.e. like a tear strip. The different-strength bonding of the carrier to the cover film at least in one section of the channel can provide advantages in the present invention regardless of the provision of a tear-off aid with two weakened regions.

According to a further embodiment of the invention, at least one tear-off tab in one piece with the carrier or the cover film is provided between the weakened regions located one behind the other. Also both the carrier and the cover film can each be provided with at least one tear-off tab. This tear-off tab is configured, for example, as a section which, if it is in one piece with the carrier, is not connected to the cover film and vice versa. Thus, for example, the tear-off tab can be a protruding region which is particularly easy to grasp in order to open the packaging. Tear-off tabs can also be provided both on the carrier and on the cover film which are pulled apart to open the packaging. If two tear-off tabs, i.e. both on the carrier and on the cover film, are provided, the carrier and the cover film can be grasped particularly easily and preferably pulled apart in a peelable manner. Thus, the packaging can be torn off in one pull from both sides so that, for example, the exposed applicator together with the packaging section having the chamber(s) can drop onto a suitable support, such as a table.

Alternatively or additionally to this, a tear-off strip or a tear-off thread can be integrated into the packaging so that part of the packaging can be torn off or torn away along a line defined by the tear-off strip or the tear-off thread. For this purpose, the tear-off strip or the tear-off thread can project over the carrier and/or the cover film.

The previously described opening of the packaging is initially used substantially to expose the applicator or make it accessible. Thus, the at least one substance accommodated in the packaging is not necessarily also freely accessible. Rather it is preferable if a discharging channel for transferring a substance from one chamber into another chamber, which opens under application of pressure to at least one of the chambers via a desired breaking point, is provided between the two chambers. This desired breaking point can, for example, be a peelable region, a region having weaker sealing or the like. Thus, even after tearing off the section of the packaging between the two weakened regions of the channel, the substance is initially still accommodated in a hermetically sealed manner inside the chambers.

According to a preferred embodiment of the invention, the applicator comprises a conical section wherein the channel is configured in a funnel shape in sections, particularly adjacent to the tear-off aid, in such a manner that the channel can be sealed by the applicator. Such sealing of the channel by the applicator is particularly helpful if the packaging is to be temporarily sealed by the applicator. The funnel-shaped configuration of the section of the channel adjacent to the tear-off aid simultaneously serves as an insertion aid when the applicator is to be inserted in the channel again.

In a further development of this inventive idea, it is provided that retaining means assigned to one another for detachable fixing of the applicator in the channel are provided on the outer surface of the applicator and on the inner surface of the channel. Thus, even after tearing off a part of the packaging, the applicator itself does not fall out of the channel but stays held therein. The retaining means can be configured, for example, by a groove in the outer surface of the applicator and a correspondingly inwardly projecting web or the like on the inner surface of the channel.

The applicator can fundamentally have any shape which is suitable for discharging and/or applying the at least one substance. Thus, the applicator can be a discharging tube, a mixer, a phial, a paintbrush or the like. According to a preferred embodiment, the applicator is provided with an elongate handle and a, for example, paintbrush- or sponge-like head. The applicator can thus be gripped easily and securely whilst the head is suitable for receiving the substance in the packaging and for applying the substance.

In this case, it is preferable if the handle of the applicator is accommodated in the channel and the head of the applicator is accommodated in a chamber. In other words, the applicator is preferably accommodated in the packaging such that the head points towards the chamber filled with the substance whilst the elongate handle points away from the chamber. After the previously described opening of the packaging by tearing off the packaging section between the two weakened regions of the channel, the handle of the applicator is thus exposed so that the applicator can be removed. The applicator can however also be pushed further into the packaging in order to open an access to the chamber which accommodates a substance. Alternatively to this, it is also possible for the substance to be squeezed from one chamber into an initially empty chamber in which the applicator head projects so that the substance can be removed from this discharging chamber by the applicator.

The packaging according to the invention can have one or more chambers which are formed in the carrier and/or the cover film. Thus, for example, different substances can be accommodated in two chambers which are only intended to be mixed with one another directly before application of these substances. It is further possible to provide an initially empty chamber which serves as a mixing chamber or as a discharging chamber from which the applicator can remove the at least one substance.

Both the carrier and the cover film preferably consist of a thin, film-like material. In this case, the carrier and the cover film need not consist of identical material. Rather, the carrier can consist of a stiffer material compared to the cover film. Fundamentally, it is preferable if the packaging consists of a plastic or plastic-metal composite material or metal in the manner of a blister pack. A blister pack is understood here in general, for example, as a deep-drawn part made of transparent and/or non-transparent material.

The packaging according to the invention is particularly suitable for the storage of liquid or pasty substances. The packaging is preferably used for storing and for discharging dental products, for example, adhesives or the like.

The invention is explained in further detail hereinafter with reference to an exemplary embodiment and with reference to the drawings.

DESCRIPTION OF THE DRAWINGS

The invention will be described in more detail below with the aid of examples of embodiment and with reference to the drawing.

Schematically.

DETAILED DESCRIPTION

The packaging 1 shown in FIGS. 1-4 includes a carrier 2 and a cover film 3 which is connected to the carrier 2 to produce the packaging. In the embodiment shown two depressions 4*a* and 4*b* are formed in the carrier 2, which form closed chambers after application of the cover film 3. Furthermore, elongate depressions 5*a* or 5*b* are also formed in the carrier 2 and in the cover film 3 which jointly form a channel having a circular cross-section in sections.

Figure 1:
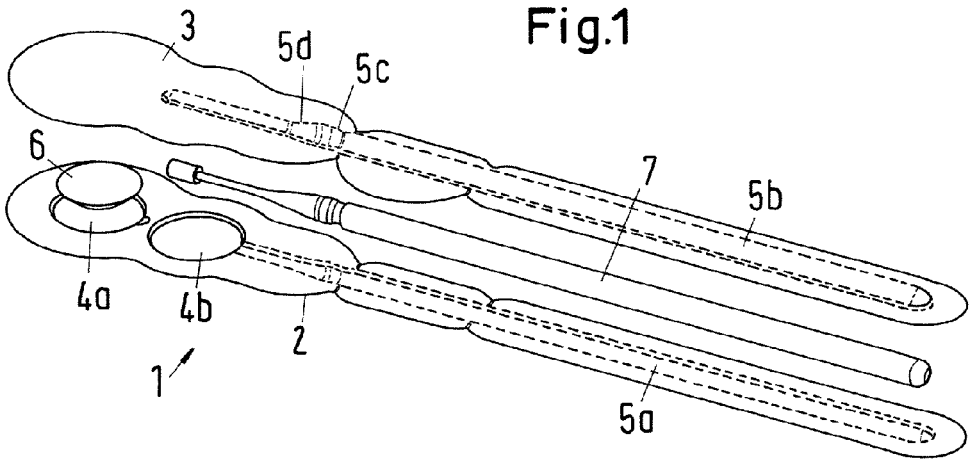
FIG. 1 shows in perspective view the components of a packaging according to the invention.
Figure 3:
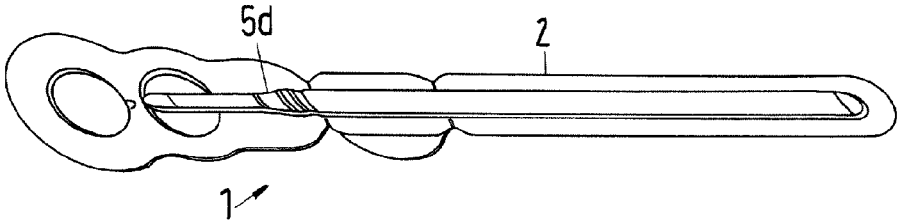
FIG. 3 shows in perspective view the packaging according to FIG. 1 in its closed state.
Figure 2:
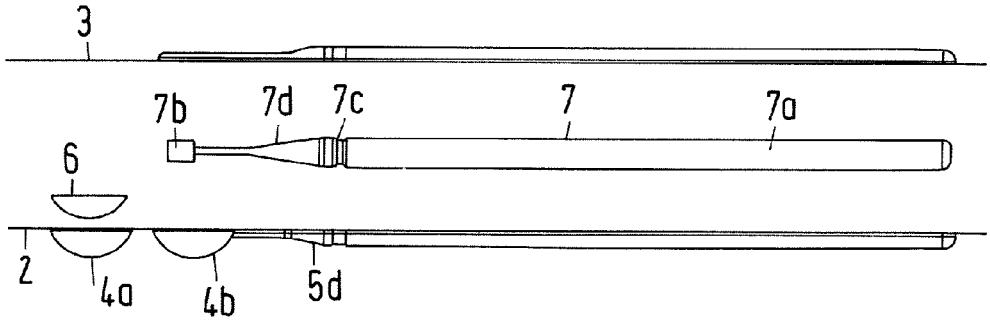
FIG. 2 shows in side view the packaging according to FIG. 1 with an applicator.

As is apparent from FIGS. 1 and 2, a substance 6 is accommodated in the left-hand depression 4*a* in the figures whereas an elongate applicator 7 is inserted in the second (right-hand) depression 4*b* and in the channel. The applicator 7 in this case has an elongate handle 7*a* and a, for example, sponge-like head 7*b* which is accommodated in the second depression 4*b*.

Figure 4:
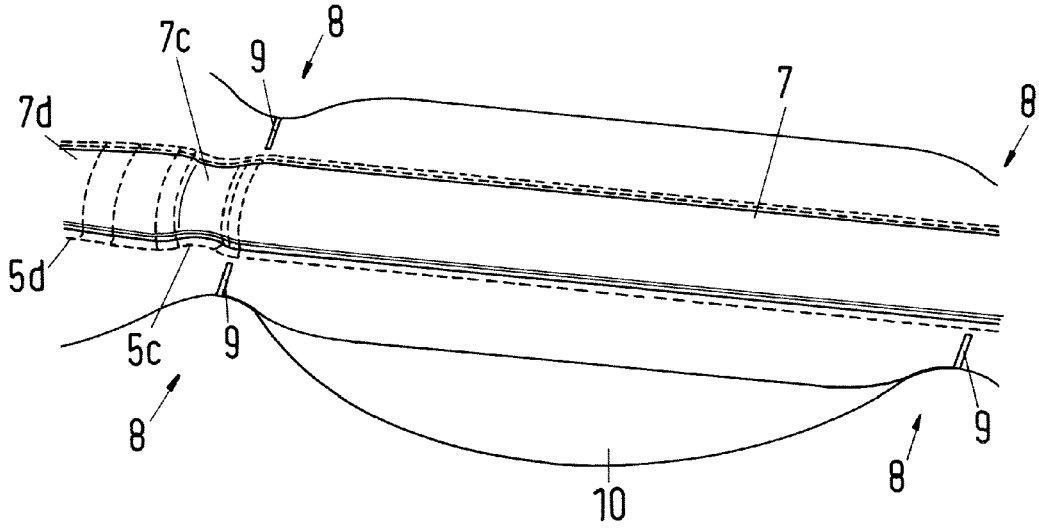
FIG. 4 shows a detail of the packaging from FIG. 1.

It is apparent from the diagram in FIG. 4 that the applicator 7 has a peripheral groove 7*c* whereas the channel has a constricted region 5*c* which engages in the groove 7*c* of the applicator 7. By this means the applicator 7 is detachably fixed in the packaging 1. Furthermore, the applicator 7 has a region 7*d* tapering conically in the direction of the head 7*b* whereas a funnel-shaped region 5*d* is formed in the channel. The conical region 7*d* of the applicator together with the funnel-shaped region 5*d* of the channel forms a sealing surface by which the channel can be sealed by the applicator 7.

In order to join the carrier 2 to the cover film 3, these are sealed, adhesively bonded or welded to one another. In this case, the region between the two depressions 4*a* and 4*b* in the carrier 2 is connected to the cover film 3 so that in the packaged state the substance 6 cannot flow from the chamber formed by the depression 4*a* into the chamber formed by the depression 4*b*. The connection of the carrier 2 to the cover film 3 is provided with a desired breaking point in this region between the depressions 4*a* and 4*b* so that the substance 6 can be transferred into the chamber defined by the depression 4*b* when the chamber formed by the depression 4*a* is compressed. Alternatively or additionally the at least one chamber which accommodates the substance can also be opened by the applicator 7 piercing the desired breaking point, by pushing or sliding this into the packaging.

As is particularly apparent from the enlarged view in FIG. 4, the carrier 2 and the cover film 3 in the area of the channel are provided on both sides with two constrictions 8 spaced apart from one another in the longitudinal direction of the channel. In addition, in the area of these constrictions 8 incisions 9 are provided in the carrier 2 and in the cover film 3 so that two weakened regions are formed in the packaging 1 which lie one behind the other in the longitudinal direction of the channel or the applicator 7. The section of the packaging 1 located between these two weakened regions is configured in the manner of a tear-off strip to allow a defined opening of the packaging 1 so that the handle 7*a* of the applicator 7 is exposed.

For this purpose, a tab 10 projecting beyond the carrier 2 is formed on the cover film 3 which can be grasped to open the packaging 1. On the side of the tab 10, the connection between the carrier 2 and the cover film 3 is configured to be weaker between the two weakened regions or provided with a desired breaking point whilst the connection between the carrier 2 and the cover film 3 is not weakened on the side of the packaging 1 opposite to the tab 10. As a result it is achieved that the cover film 3 can easily be detached from the carrier 2 when a user pulls on the tab 10. Due to the constrictions 8 and the incisions 9, a defined initiation of tearing is achieved in the cover film 3 so that the section of the cover film 3 located between the two weakened regions is detached from the carrier 2. In this case, a region of the handle 7*a* of the applicator 7 is exposed. Due to the (firmer) connection between the carrier 2 and the cover film 3 on the side opposite the tab 10, complete detachment of the cover film 3 from the carrier 2 is avoided and tearing in the cover film 3 continues in the carrier 2 so that the entire section of the packaging 1 around the applicator 7 lying between the two weakened regions can be torn off.

The left end of the packaging 1 with the depressions 4*a*, 4*b* in FIGS. 1 and 2 is therefore separated from the right end of the packaging 1 so that this right end of the packaging in FIGS. 1 and 2 can be pulled away from the applicator 7. In the embodiment shown, after exposing the handle 7*a* of the applicator, the chamber containing the substance 6, formed by the depression 4*a* is still closed. However it is also possible to configure the tear-off aid in such a manner that the substance 6 is exposed at the same time. Conversely, the packaging can first be activated by opening the desired breaking point and only then is the packaging opened by tearing off a section so that the applicator is exposed.

Figure 5:
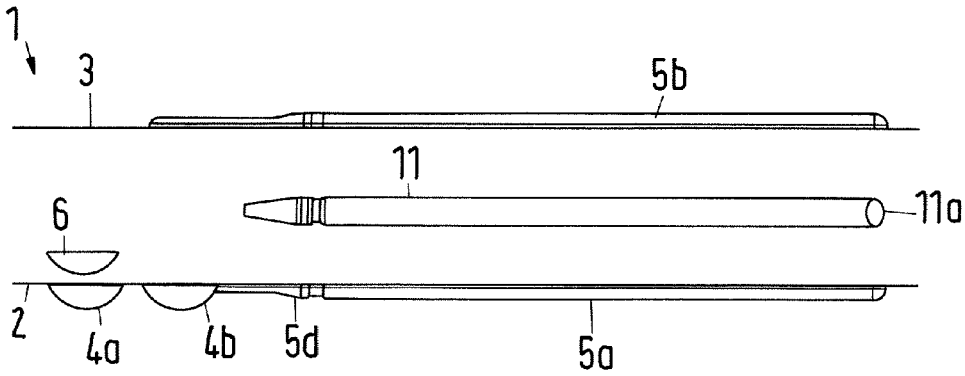
FIG. 5 shows a view according to FIG. 2 with a different applicator.

In the embodiment shown in FIG. 5, the packaging itself is constructed substantially as described previously. However, a tube 11 is provided as applicator which is inserted in the packaging. A mixer can be provided in this tube 11, particularly if several substances to be mixed together before use are accommodated in the packaging. In this case, the end 11 a provided for application of the substance(s) points away from the chamber. The tube 11 is therefore not removed from the packaging for discharging the substance(s) as is provided with the applicator 7 but remains on the packaging. The tube 11 or the mixer can be exposed particularly extensively with the packaging according to the invention, which facilitates the application when dispensing the substance(s).

Figure 6:
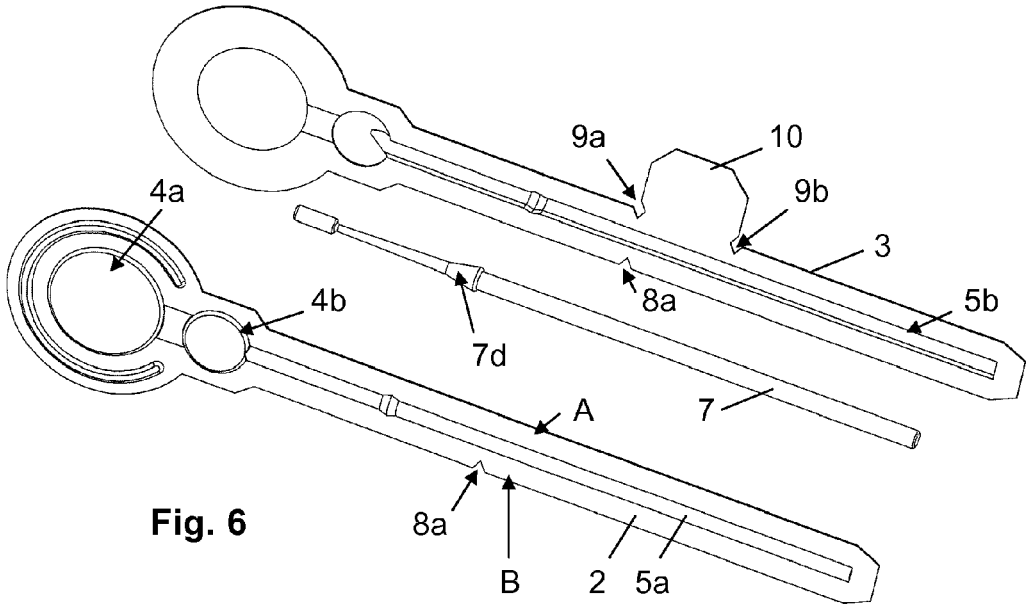
FIG. 6 shows in perspective view the components of a packaging according to a further embodiment of the invention.
Figure 7:
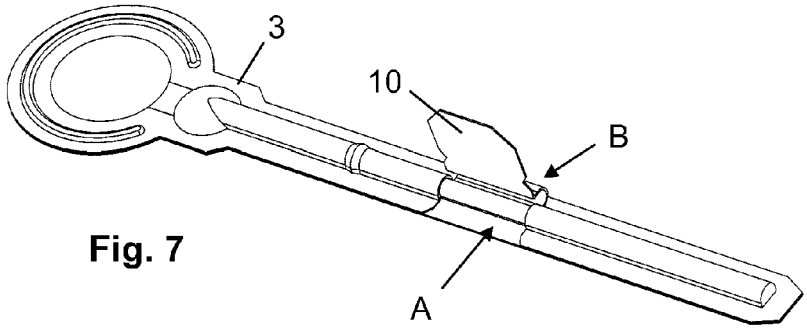
FIG. 7 shows the packaging of FIG. 6 during opening.
Figure 8:
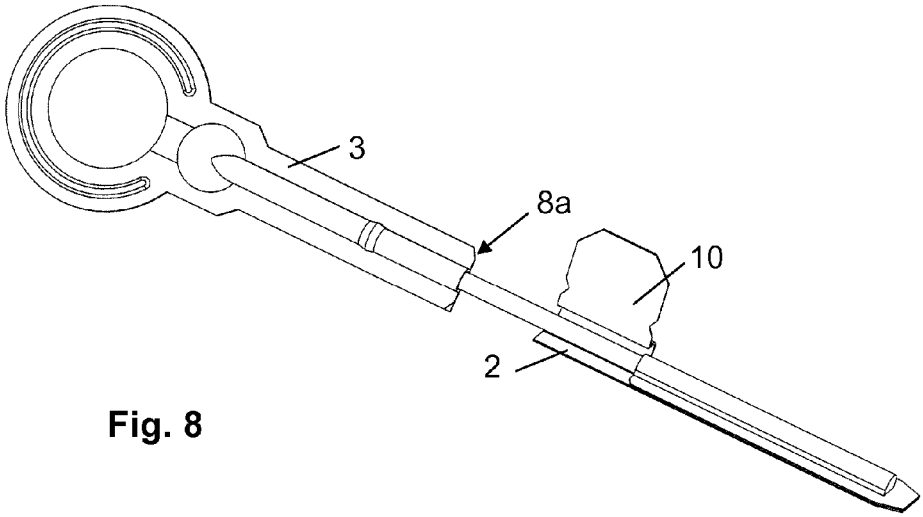
FIG. 8 shows the packaging of FIG. 6 after opening.

A further embodiment of the packaging is illustrated in FIGS. 6 to 8, which packaging has substantially the same configuration like the embodiment of FIGS. 1 to 5. Likewise, the packaging is composed of a film-like carrier 2 and a cover film 3 joint together by a sealing, a bonding, a welding or the like.

The cover film 3 is integrally formed with a tear-off tab 10 with incisions (cuts) 9*a*, 9*b* being provided on either side of the tear-off tab 10 in the cover film 3, which incisions do not go to the channel 5*a* such that the applicator 7 is sealingly encased. On the other hand, the respective part of the carrier 2 is not weakened. On the side of the channel opposite the tear-off tab 10 a notch or groove 8*a* is formed in the carrier 2 and the cover film 3, i.e. a notch is provided in both layers. Said notch is located opposite to incision 9*a* and is spaced from the broadened section of the channel receiving the conical sealing 7*d* of the applicator 7 in a direction facing away from depressions 4*a*, 4*b*. In FIGS. 6 to 8 the conical sealing 7*d* is provided with a step (located in the direction of the handle 7*a*) to prevent the applicator 7 from falling off the opened packaging. In other words, at least a part of the channel has to be broadened during the first removal of the applicator from the packaging. This broadened part makes it easy to re-insert the applicator to withdraw additional substances.

The joining between the carrier 2 and the cover film 3 is weaker in a region A of the tear-off tab 10, i.e. between incisions 9*a*, 9*b*. This can be achieved by a thinner joining area and/or a weaker joining. Preferably, the outer edge (border) of the packaging at least in region A near the tear-off tab 10 is not provided with a joining between the carrier and the cover film, such that these two layers simply bear on each other or may be separated by an air gap. This makes it easy to detach the carrier 2 from the cover film 3 with the tear-off tab 10. However, the joining on the opposite side of the channel is stronger in a region B, such that the carrier 2 and the cover film 3 may not be separated from each other in this region B during opening of the packaging.

As shown in FIGS. 7 and 8 the tear-off tab 10 and the right section (as seen in FIG. 6) of the cover film 3 and the carrier 2, i.e. the section covering the handle of the applicator 7, remain attached to each other and are separated as one part from the left section (as seen in FIG. 6) which is provided with the depressions 4*a*, 4*b*.

In contrast to what is shown in FIGS. 6 to 8, according to a preferred embodiment of the invention the tear-off tab may be provided on the carrier instead of the cover film. Thus, incisions 9*a*, 9*b* would be provided in the carrier.

Figure 9A:
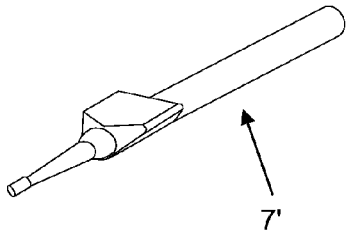
FIGS. 9*a-f* show further embodiments of packagings according to the invention.
Figure 9B:
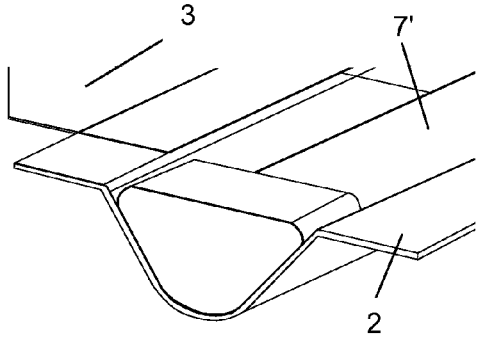
Figure 9C:
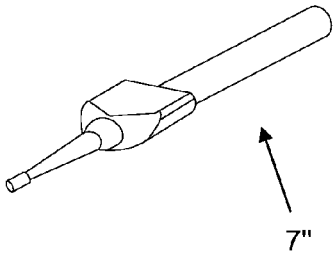
Figure 9D:
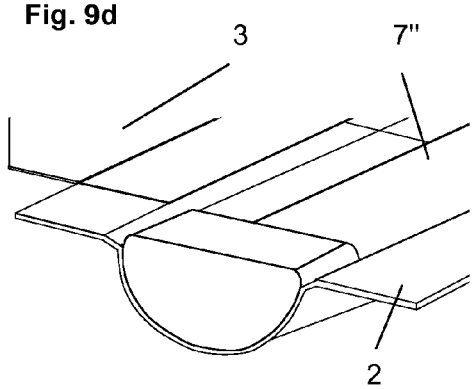
Figure 9E:
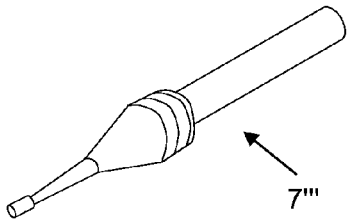
Figure 9F:
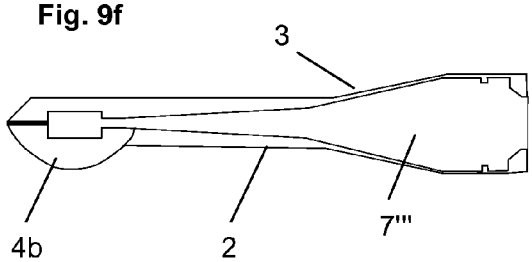

Further, the geometry of the part of the channel holding the conical seal of the applicator may be different from what is shown in the embodiment of FIGS. 6 to 8. The depression (embossing) in the carrier may be V-shaped (FIG. 9*b*) with the applicator 7' having a triangular profile (FIG. 9*a*) at least in this area. Further, the applicator 7" may have a flat upper face (FIG. 9*c*) to sealingly abut the flat cover film 3 (FIG. 9*d*). As shown in FIGS. 9*e* and 9*f* embodiments with a depression or the like protrusion in the cover film 3 may also be possible. In the latter case, the applicator 7'" has a conical sealing area.

Preferably the components of the packaging, i.e. the films and the applicator, may be sterilized.

Exemplary embodiments of the present invention have been described. Those skilled in the art will understand, however, that changes and modifications may be made to these embodiments without departing from the true scope and spirit of the present invention, which is defined by the claims.

The invention claimed is:

1. A tearable packaging for receiving at least one substance and an applicator for applying the at least one substance, the tearable packaging comprising a carrier in which at least one depression open on one side is formed which is sealed towards the outside of the packaging with a cover film to form at least one chamber and comprising a channel formed between the carrier and the cover film in which the applicator is accommodated at least in sections in such a manner that the applicator is completely enclosed by the carrier and the cover film, wherein a tear-off aid for defined opening of the packaging is provided in the region of at least one of the carrier and the cover film in which the channel is provided, wherein the tear-off aid comprises at least one tear-off tab integrally formed with the carrier or the cover film and projecting beyond the carrier, wherein a joining between the carrier and the cover film is weaker in a first region of the joining in which said at least one tear-off tab is located compared with a second region located opposite said at least one tear-off tab, and wherein said tear-off aid has first and second weakened regions located one behind the other in a longitudinal direction of said channel, wherein after detaching the carrier and cover film from each other in the first weakened region, a tearing is defined which extends within one of the carrier and cover film, which tearing continues to extend within the other of the carrier and cover film.

2. The tearable packaging according to claim 1, wherein a weakening in the region of the at least one tear-off tab is provided only in the material of the carrier or the cover film which is integrally formed with the tear-off tab, and a weakening in the region located opposite the tear-off tab is provided in the carrier and the cover film.

3. The tearable packaging according to claim 1, wherein a weakening is provided on each side of the at least one tear-off tab in the longitudinal direction of the channel only in the material of the carrier or the cover film which is integrally formed with the at least one tear-off tab, such that two weakened regions located one behind the other in the longitudinal direction of the channel are formed.

4. The tearable packaging according to claim 1, wherein the applicator is a tube or mixer, and wherein the end of the applicator provided for discharging the at least one substance points away from the at least one chamber.

5. The tearable packaging according to claim 1, wherein the tear-off tab is folded onto the carrier or the cover film perpendicular to the longitudinal direction of the channel with the tear-off tab protruding with its free end over the carrier and the cover film.

6. The tearable packaging of claim 1 further comprising a first and second incision, the first and the second incisions spaced apart from one another.

7. The tearable packaging of claim 6 wherein at least the first incision is provided in at least the carrier.

8. The tearable packaging of claim 6 wherein at least the first incision is provided in at least the cover film.

9. The tearable packaging of claim 6 wherein the first incision and the second incision is provided in at least the carrier.

10. A tearable packaging for receiving at least one substance and an applicator for applying the at least one substance, the tearable packaging comprising a carrier in which at least one depression open on one side is formed which is sealed towards the outside of the packaging with a cover film to form at least one chamber and comprising a channel formed between the carrier and the cover film in which the applicator is accommodated at least in sections in such a manner that the applicator is completely enclosed by the carrier and the cover film, wherein a tear-off aid for defined opening of the packaging is provided in the region of at least one of the carrier and the cover film in which the channel is provided, wherein the tear-off aid comprises at least one tear-off tab integrally formed with the carrier or the cover film and projecting beyond the carrier, wherein a joining between the carrier and the cover film is weaker in a first region of the joining in which said at least one tear-off tab is located compared with a second region located opposite said at least one tear-off tab, and wherein after opening of the packaging the at least one tear-off tab and a first section of the cover film and the carrier remain attached to each other and are separated as one part from a second section and by detaching the carrier and the cover film from each other in said first region of said at least one tear-off tab, a tearing is defined which extends within one of the carrier and the cover film, which tearing crosses said second region located opposite said at least one tear-off tab and the tearing continues to extend within the other of the carrier and the cover film.

11. The tearable packaging according to claim 1 or claim 10, wherein weakenings are located opposite each other and abutting to the at least one tear-off tab on the side of the channel facing towards the at least one depressions.

12. The tearable packaging according to claim 1 or claim 10, wherein the joining between the carrier and the cover film does not range to the outer edge of the packaging in the region of the at least one tear-off tab.

13. The tearable packaging according claim 1 or 10, wherein at least on one side of the channel a weakening in the carrier or the cover film is more strongly defined than in the other of said cover film or said carrier.

14. The tearable packaging according to claim 1 or 10, wherein on both sides of the channel respectively two weakened regions located one behind the other in a row in the longitudinal direction of the channel are provided.

15. The tearable packaging according to claim 1 or 10, wherein between at least one of two chambers or one chamber and the channel there is provided a discharging channel for transferring a substance from one chamber into another chamber or the channel, which opens under application of pressure to at least one of the chambers via a desired breaking point.

16. The tearable packaging according to claim 1 or 10, wherein the applicator comprises a conical section and the channel is configured in a funnel shape in sections in such a manner that the channel can be sealed by the applicator.

17. The tearable packaging according to claim 1 or 10, wherein retaining means assigned to one another for detachable fixing of the applicator in the channel are provided on the outer surface of the applicator and on the inner surface of the channel.

18. The tearable packaging according to claim 1 or 10, wherein the applicator has an elongate handle.

19. The tearable packaging according to claim 18, wherein the applicator has a paintbrush or sponge head.

20. The tearable packaging according to claim 18, wherein the handle of the applicator is accommodated in the channel and the head of the applicator is accommodated in a chamber.

21. A container that can be configured to contain a substance and an applicator for applying the substance, the container comprising:

a deformable carrier comprising a depression that can be sealed towards an outside of the container with a cover to form at least one chamber;

a channel between the deformable carrier and the cover configured to enclose an applicator for applying a substance, and an integral tear-off component for opening the packaging, the tear-off component provided in a region of at least one of the carrier and the cover in which the channel is provided;

wherein a joining between the carrier and the cover film is weaker in a first region of the joining in which said at least one tear-off tab is located compared with a second region of the joining located opposite said at least one tear-off tab, said at least one tear-off tab projecting beyond the carrier, after detaching the carrier and the cover film from each other in said first region of said at least one tear-off tab, a tearing is defined which extends within one of the carrier and the cover film, which tearing crosses said second region located opposite said at least one tear-off tab and the tearing continues to extend within the other of the carrier and the cover film.

22. The container of claim 21 further comprising a first constriction and a second constriction, the first and second constrictions spaced apart from one another.

23. The container of claim 22 further comprising two weakened regions located one behind the other in a longitudinal direction of said channel.

24. The container of claim 21 further comprising a first incision and second incision, the first and the second incisions spaced apart from one another.

25. The container of claim 24 wherein at least the first incision is provided in at least the deformable carrier.

26. The container of claim 24 wherein at least the first incision is provided in the cover.

* * * * *